US011186118B2

(12) United States Patent
Hughes

(10) Patent No.: US 11,186,118 B2
(45) Date of Patent: Nov. 30, 2021

(54) PAINT CAN CADDIE AND LID THEREFOR

(71) Applicant: Lowell Hughes, Lithia Springs, GA (US)

(72) Inventor: Lowell Hughes, Lithia Springs, GA (US)

( * ) Notice: Subject to any disclaimer, the term of this patent is extended or adjusted under 35 U.S.C. 154(b) by 8 days.

(21) Appl. No.: 16/218,843

(22) Filed: Dec. 13, 2018

(65) Prior Publication Data

US 2019/0351698 A1 Nov. 21, 2019

Related U.S. Application Data

(63) Continuation-in-part of application No. 15/984,778, filed on May 21, 2018, now abandoned.

(51) Int. Cl.
*B44D 3/12* (2006.01)
*B44D 3/14* (2006.01)

(52) U.S. Cl.
CPC ..... *B44D 3/14* (2013.01); *B44D 3/127* (2013.01)

(58) Field of Classification Search
CPC . B44D 3/14; B44D 3/128; B44D 3/12; B44D 3/127
USPC ..... 220/630, 571.1, 570, 571; 428/40.1; 215/376, 393, 392; 206/515, 813; 229/915
See application file for complete search history.

(56) References Cited

U.S. PATENT DOCUMENTS 3,279,638 A * 10/1966 Merry ..... A47G 19/22 215/395
3,351,227 A * 11/1967 Collie ..... B65D 43/0212 220/788
4,998,696 A * 3/1991 Desjardins ..... B44D 3/12 220/737
6,253,951 B1 * 7/2001 Pruckler ..... B44D 3/128 220/359.1
2006/0096989 A1 * 5/2006 Lucey ..... B44D 3/128 220/495.11
2008/0022937 A1 * 1/2008 Shirley ..... A01K 7/005 119/72

* cited by examiner

*Primary Examiner* — James N Smalley
*Assistant Examiner* — Elizabeth J Volz
(74) *Attorney, Agent, or Firm* — The Iwashko Law Firm, PLLC; Lev Ivan Gabriel Iwashko

(57) ABSTRACT

A paint can caddie, including a can receiving portion to receive a base and at least a portion of an outer circumference of a paint can therein, and a paint storing portion circumferentially disposed around the can receiving portion to receive paint spilled from the paint can.

8 Claims, 4 Drawing Sheets

PAINT CAN CADDIE AND LID THEREFOR

CROSS REFERENCE TO RELATED APPLICATION

This application is a continuation in part of co-pending U.S. nonprovisional patent application Ser. No. 15/984,778, entitled "Paint Can Caddie," which was filed on May 21, 2018.

BACKGROUND

1. Field

The present general inventive concept relates generally to paint can caddie, and specifically, to a paint can caddie and a lid therefor.

2. Description of the Related Art

Painting is an exciting job, but is often laborious given the fact that paint-spills are quite common. This is especially true for people who paint their homes themselves and are often forced to use hundreds of newspapers or other materials as a covering for the floor. However, even if a floor is covered with newspapers or other materials, spilled paint may still seep through and cause stains to the floor.

Therefore, there is a need for device that prevents paint from spilling from a paint can onto a floor.

Also, there is a need for a lid for such a device, in order to aid in maintaining the paint within the device, while keeping the paint stored therein fresh.

SUMMARY

The present general inventive concept provides a paint can caddie and a lid therefor.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a paint can caddie, including a can receiving portion to receive a base and at least a portion of an outer circumference of a paint can therein, and a paint storing portion circumferentially disposed around the can receiving portion to receive paint spilled from the paint can.

The paint can caddie may further include a removable lid attached to a top portion of the paint storing portion.

The removable lid may include an inward declining top surface sloping downward from an outer edge of the inward declining top surface toward an inner edge of the inward declining top surface to direct spilled paint thereon into the paint storing portion.

The paint can caddie may further include a gap formed between the inner edge of the inward declining top surface and the inner wall of the paint storing portion to allow the paint to enter the paint storing portion.

The removable lid may include a plurality of inward protruding ribs disposed on at least a portion of an outer surface of the removable lid.

The paint storing portion may include a plurality of rib receiving indentations disposed on at least a portion of an outer surface of the paint storing portion to each receive one of the plurality of inward protruding ribs.

The can receiving portion may further include a plurality of vertical ribs to accommodate a predetermined range of size of the paint can, such that the plurality of vertical ribs deform to allow the paint can to fit snugly within the can receiving portion.

The paint storing portion may include an inner wall disposed next to a wall of the can receiving portion, an outer wall disposed around and distanced from the inner wall, and a base disposed at a bottom portion of the paint storing portion to connect the inner wall to the outer wall.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Figure 1:
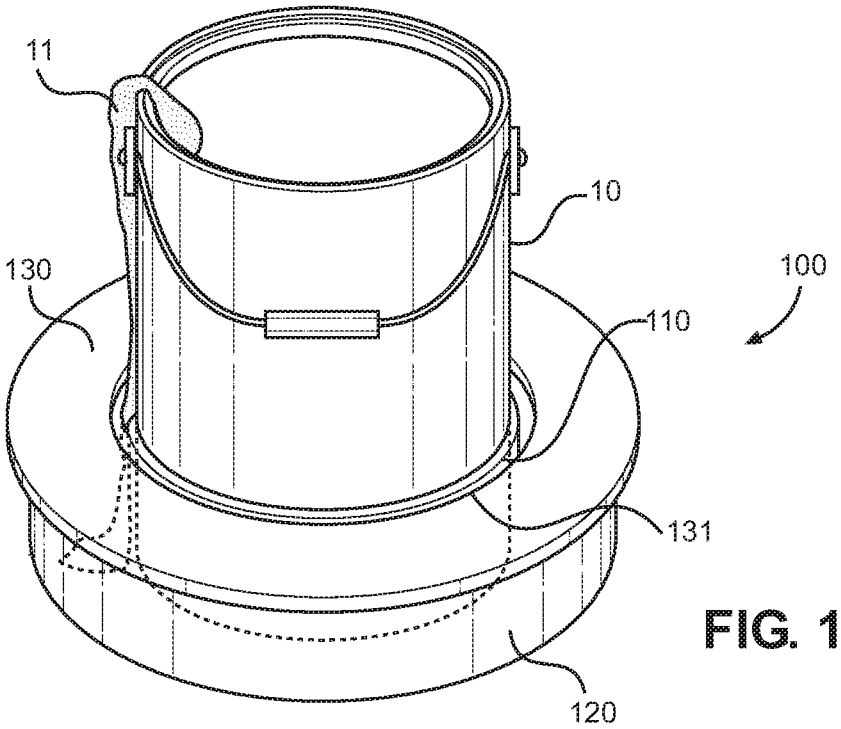
FIG. 1 illustrates a top angled view of a paint can disposed within a paint can caddie, according to an exemplary embodiment of the present general inventive concept.

FIG. 1 illustrates a top angled view of a paint can 10 disposed within a paint can caddie 100, according to an exemplary embodiment of the present general inventive concept.

Figure 2:
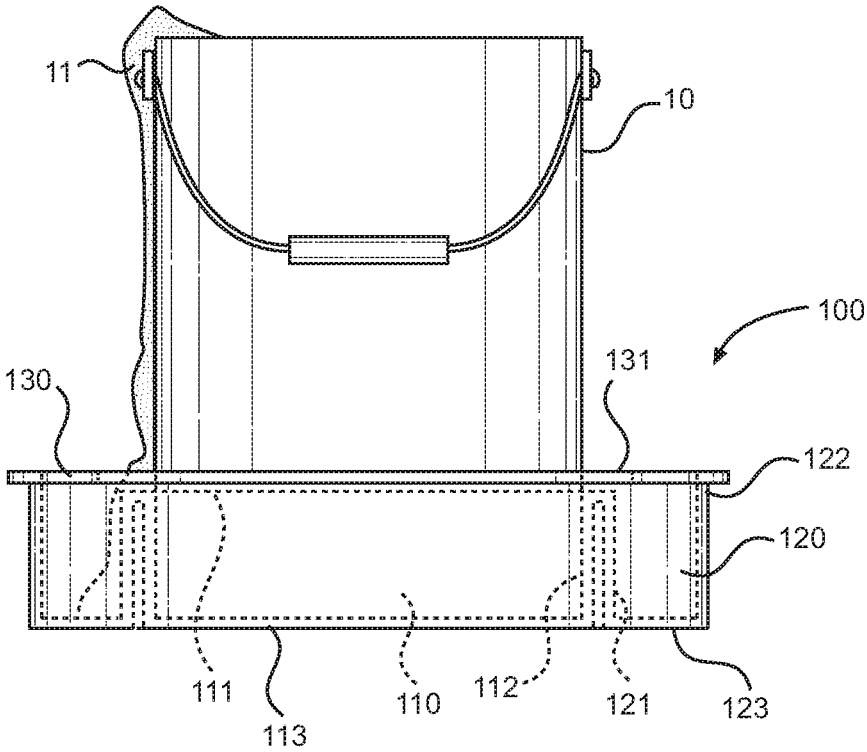
FIG. 2 illustrates a cross-sectional side view of the paint can disposed within the paint can caddie, according to an exemplary embodiment of the present general inventive concept.

FIG. 2 illustrates a cross-sectional side view of the paint can 10 disposed within the paint can caddie 100, according to an exemplary embodiment of the present general inventive concept.

Figure 3:
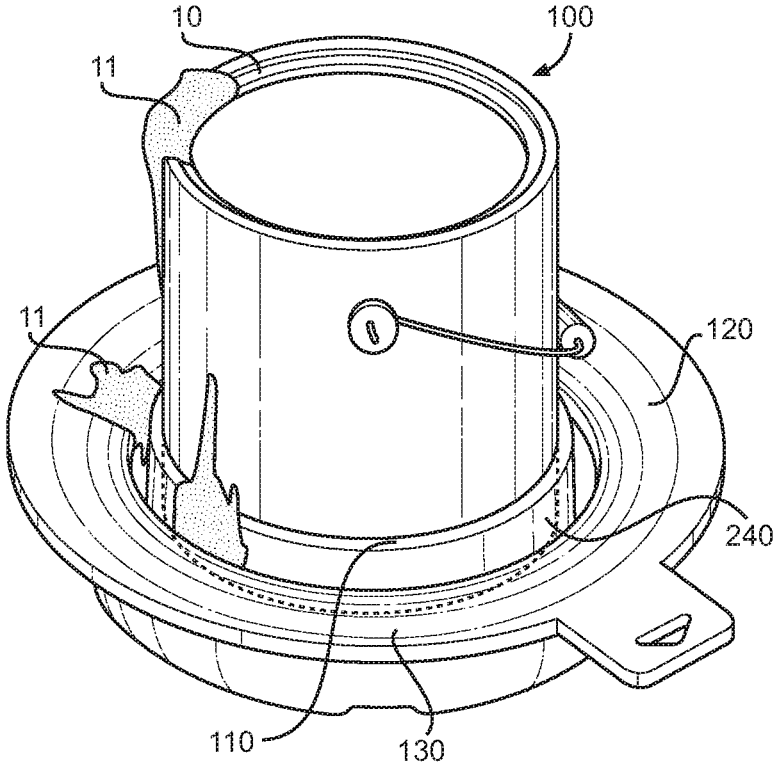
FIG. 3 illustrates an isometric view of the paint can disposed within the paint can caddie, according to an exemplary embodiment of the present general inventive concept.

FIG. 3 illustrates an isometric view of the paint can 10 disposed within the paint can caddie 100, according to an exemplary embodiment of the present general inventive concept.

The paint can caddie 100 may have a circular shape, but is not limited thereto, and can any shape known to one of ordinary skill in the art.

The paint can caddie 100 may have any size to allow the paint can 10 to be held snugly therewithin, such that the paint can caddie 100 may have any size to correspond to any size of the paint can 10.

The paint can caddie 100 may be constructed from plastic, metal, cloth, rubber, silicone, latex, wood, etc., but is not limited thereto.

The paint can caddie 100 may include a can receiving portion 110, a paint storing portion 120, and a lid 130.

Referring to FIGS. 1 and 2, the paint can 10 may be inserted into the can receiving portion 110 such that paint can 10 fits snugly into the can receiving portion 110.

The can receiving portion 110 may act as a base, such that a base of the paint can 10 may fit into the can receiving portion 110. As stated above, the can receiving portion 110 may have various sizes to allow various sizes of the paint can 10 to be fit thereinto.

The can receiving portion 110 may have a tape portion 111 disposed around an inner circumference of the can receiving portion 110, such that the paint can 10 may be snugly attached within the can receiving portion 110. The tape portion 111 may be constructed from rubber, silicon, or any other material to allow the paint can 10 to be removably adhered to an inner portion of the can receiving portion 110.

The can receiving portion 110 may have a wall 112 circumferentially disposed in a circle, and a base 113.

The paint storing portion 120 may be disposed around an outer circumference of the can receiving portion 110, such that paint 11 leaking down the paint can 10 may be caught and stored by the paint storing portion 120. In other words, the paint storing portion 120 may include an inner wall 121, an outer wall 122, and a base 123.

The inner wall 121 may be disposed next to the wall 112 of the can receiving portion 110. The outer wall 122 may be disposed around and distanced from the inner wall 121. The base 123 may be disposed at a bottom portion of the paint storing portion 120 to connect the inner wall 121 to the outer wall 122.

The removable lid 130 may be optionally removable, and may be constructed to fit over the paint storing portion 120, and may have a removed portion 131 to allow the paint 11 to seep inside the paint storing portion 120 even if the removable lid 130 is disposed on the paint storing portion 120.

More specifically, the removed portion 131 may be disposed to be distanced away from a top edge of the paint storing portion 120 to allow the paint 11 to enter the paint storing portion 120 even if the removable lid 130 is attached to the top portion of the paint storing portion 120.

As illustrated in FIGS. 1 and 2, the paint can 10 may be inserted into the can receiving portion 110, such that outer circumferential walls of the can receiving portion 110 contact an outer surface of the paint can 10, such that the paint storing portion 120 may receive the paint 11 spilled out (i.e., leaked out) from the paint can 10.

Figure 4:
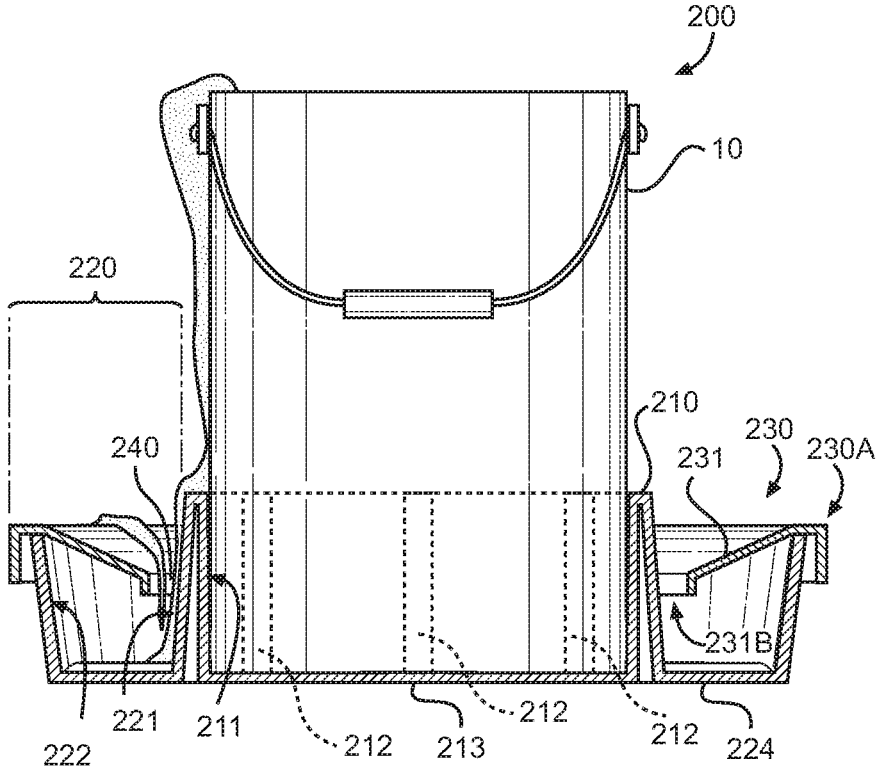
FIG. 4 illustrates a cross-sectional side view of a paint can disposed within a paint can caddie, according to another exemplary embodiment of the present general inventive concept.

FIG. 4 illustrates a cross-sectional side view of a paint can 10 disposed within a paint can caddie 200, according to another exemplary embodiment of the present general inventive concept.

Figure 5A:
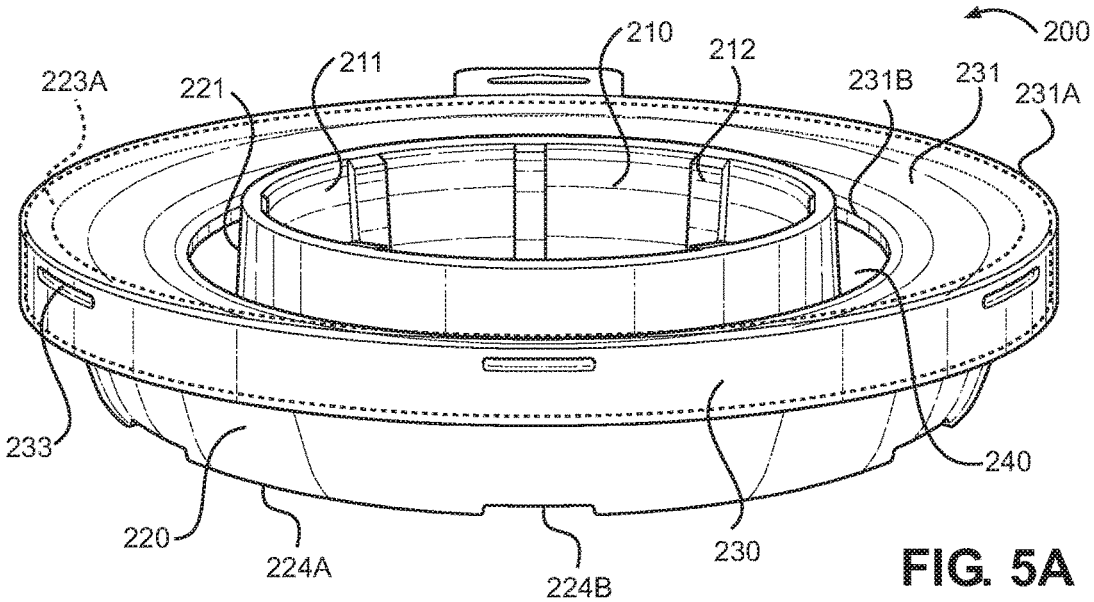
FIG. 5A illustrates a side view of a paint can caddie, according to another exemplary embodiment of the present general inventive concept.

FIG. 5A illustrates a side view of the paint can caddie 200, according to another exemplary embodiment of the present general inventive concept.

Figure 5B:
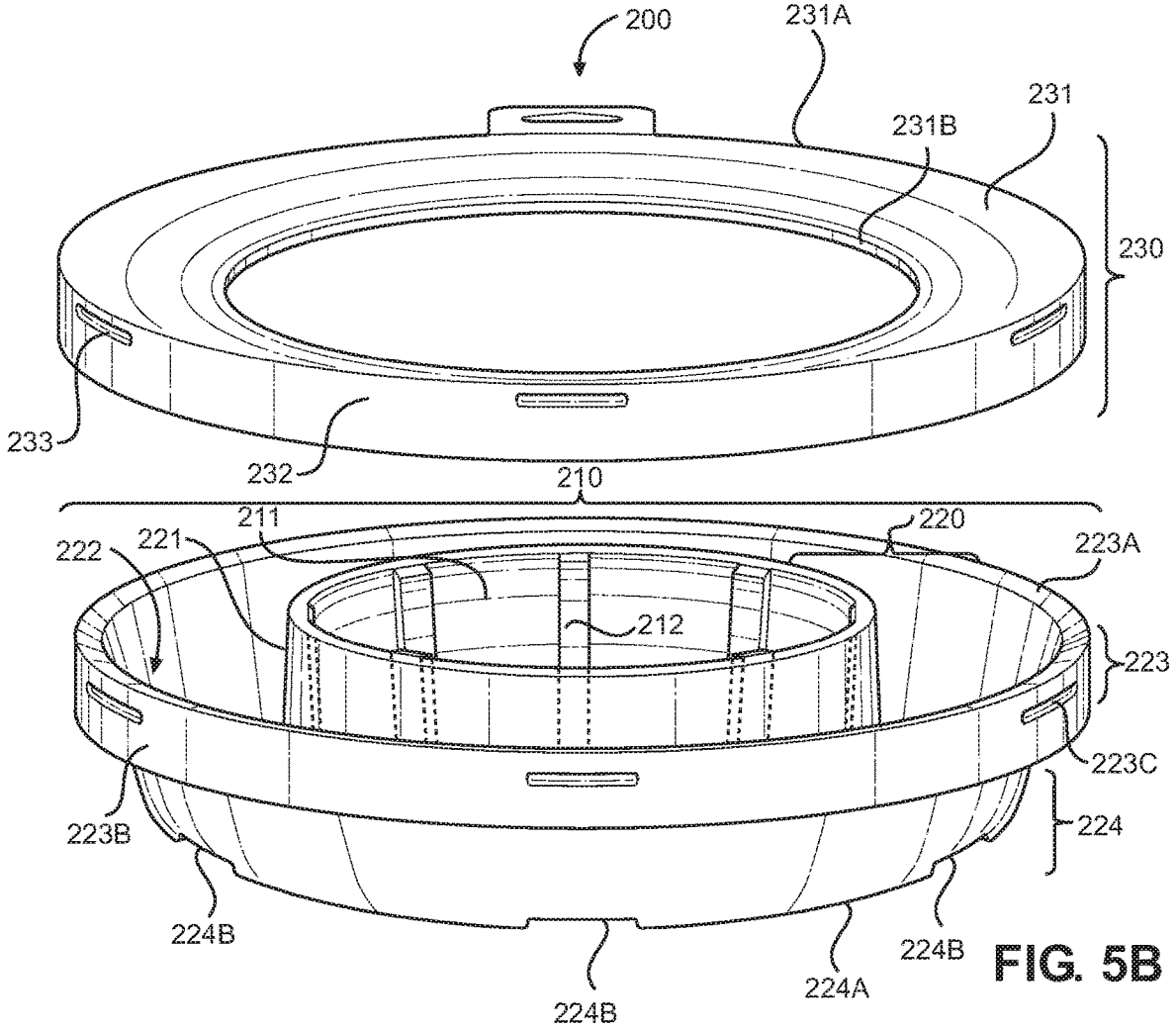
FIG. 5B illustrates an exploded view of the paint can caddie, according to another exemplary embodiment of the present general inventive concept.

FIG. 5B illustrates an exploded view of the paint can caddie 200, according to another exemplary embodiment of the present general inventive concept.

Figure 6A:
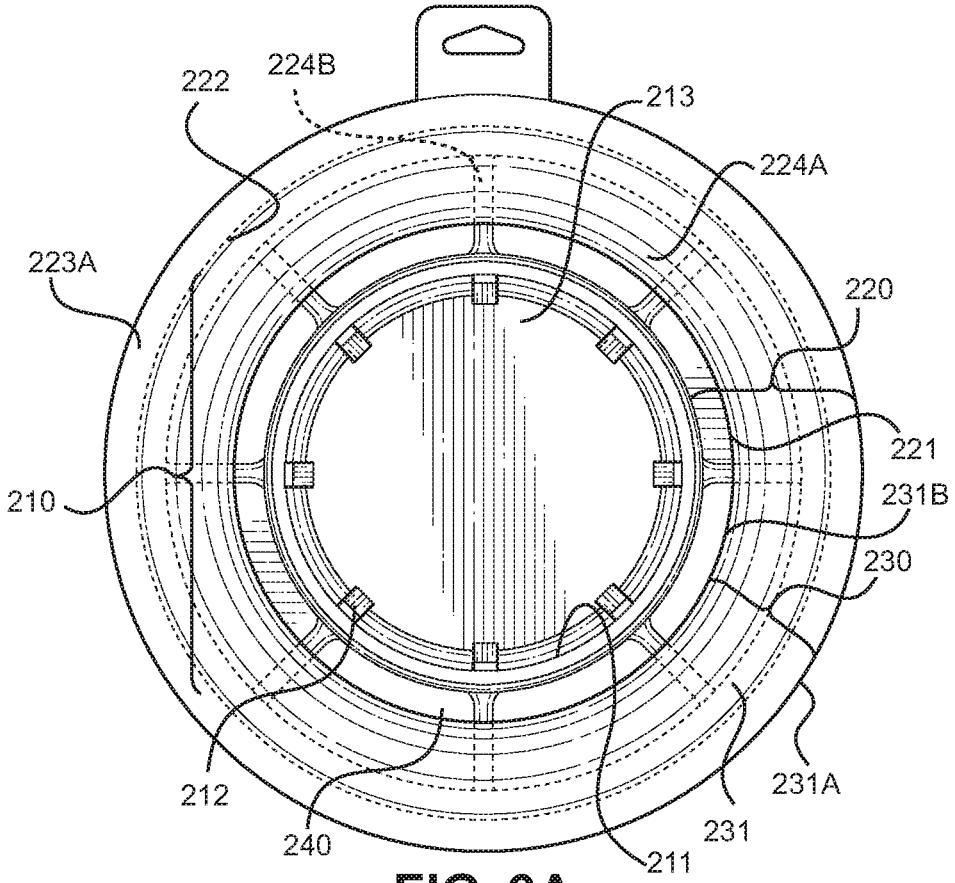
FIG. 6A illustrates a top view of the paint can caddie, according to another exemplary embodiment of the present general inventive concept.

FIG. 6A illustrates a top view of the paint can caddie 200, according to another exemplary embodiment of the present general inventive concept.

Figure 6B:
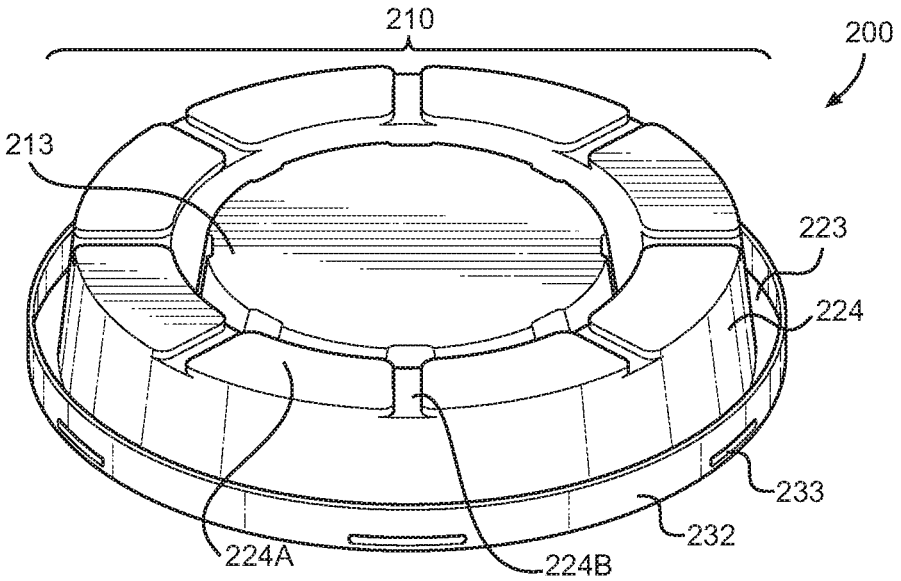
FIG. 6B illustrates an isometric bottom view of the paint can caddie, according to another exemplary embodiment of the present general inventive concept.

FIG. 6B illustrates an isometric bottom view of the paint can caddie 200, according to another exemplary embodiment of the present general inventive concept.

Referring to FIGS. 5A through 6B, the paint can caddie 200 is illustrated to have a circular shape. However, the paint can caddie 200 may be rectangular, rectangular prism, pentagonal, hexagonal, octagonal, or any other shape known to one of ordinary skill in the art, but is not limited thereto.

The paint can caddie 200 may have any size to allow the paint can 10 to be held snugly therewithin, such that the paint can caddie 200 may have any size to correspond to any size of the paint can 10.

The paint can caddie 200 may be constructed from plastic, metal, cloth, rubber, silicone, latex, wood, etc., but is not limited thereto.

The paint can caddie 200 may include a can receiving portion 210, a paint storing portion 220, and a removable lid 230, but is not limited thereto.

The can receiving portion 210 may include a wall 211, a plurality of vertical ribs 212, and a base 213, but is not limited thereto.

Referring to FIG. 4, the paint can 10 may be inserted into the can receiving portion 210 such that paint can 10 fits snugly into the can receiving portion 210.

As stated above, the can receiving portion 210 may have various sizes to allow various sizes of the paint can 10 to be fit thereinto.

The wall 211 may be circumferentially disposed in a circle within an interior of the can receiving portion 210. The plurality of vertical ribs 212 may be disposed around an inner circumference of the can receiving portion 210, such that the paint can 10 may be snugly attached within the can receiving portion 210. For example, the plurality of vertical ribs 212 may include at least eight ribs, but is not limited thereto. The plurality of vertical ribs 212 may allow the paint can 10 to be removably adhered to the wall 211 of the can receiving portion 210. Moreover, the plurality of vertical ribs 212 may allow the can receiving portion 210 to accommodate a predetermined range of size of the paint can 10, such that the can receiving portion 210 may be universally sized for the paint can 10.

Also, the plurality of vertical ribs 212 may deform slightly to allow the paint can 10 to fit snugly within the can receiving portion 210.

The paint storing portion 220 may include an inner wall 221 and an outer wall 222, but is not limited thereto.

The outer wall 222 may include a top portion 223 and a bottom portion 224, but is not limited thereto.

The top portion 223 may include a lip 223*a*, an outer surface 223*b*, and a plurality of rib receiving indentations 223*c*, but is not limited thereto.

The bottom portion 224 may include a base 224*a* and a plurality of horizontal ribs 224*b*, but is not limited thereto.

The paint storing portion 220 may be disposed around an outer circumference of the can receiving portion 210, such that paint leaking down the paint can 10 may be caught and stored by the paint storing portion 220. Specifically, paint leaking down the paint can 10 may drip down toward the inner wall 221 and collect on the base 224*a* of the bottom portion 224.

The inner wall 221 of the paint storing portion 220 may be disposed next to the wall 211 of the can receiving portion 210. The outer wall 222 may be disposed around and distanced from the inner wall 221. The base 224*a* may be disposed at a bottom portion of the paint storing portion 220 to connect the inner wall 221 to the outer wall 222.

The lip 223*a* of the top portion 223 may be inclined slightly at a predetermined angle, such that the lip 223*a* slopes inward toward the paint storing portion 220. Furthermore, the plurality of rib receiving indentations 223*c* may be disposed on at least a portion of the outer surface 223*b* of the top portion 223.

Referring to FIG. 6A, the plurality of horizontal ribs 224*b* may be disposed on at least a portion of the base 224*a* of the bottom portion 224. The plurality of horizontal ribs 224*b* may be protrusions with respect to the base 224*a* for each of the plurality of horizontal ribs 224*b*. Moreover, the plurality of horizontal ribs 224*b* correspond to the plurality of vertical ribs 212 within the can receiving portion 210. The plurality of horizontal ribs 224*b* may stabilize the paint can caddie 200 when it is disposed on a substantially flat surface, such as a table or a floor.

The removable lid 230 may include an inward declining top surface 231, an outer surface 232, and a plurality of inward protruding ribs 233, but is not limited thereto.

The inward declining top surface 231 may include an outer edge 231*a* and an inner edge 231*b*, but is not limited thereto. The inward declining top surface 231 may slope downward from the outer edge 231*a* toward the inner edge 231*b*, in order to direct spilled paint thereon into the paint storing portion.

The plurality of inward protruding ribs 233 may be disposed on at least a portion of the outer surface 232. The removable lid 230 may be constructed to substantially cover the paint storing portion 220. Specifically, the inward declining top surface 231 may be constructed, such that the outer edge 231*a* is substantially higher in elevation with respect to the inner edge 231*b*. As such, a bottom surface of the inward declining top surface 231 may be affixed and/or adhered to the lip 223*a* of the top portion 223. Moreover, an inner portion of the outer surface 232 may contact the outer surface 223*b* of the top portion 223. As such, the plurality of inward protruding ribs 233 on the removable lid 230 may be inserted into each of the plurality of rib receiving indentations 223*c* on the top portion 223. In other words, the plurality of rib receiving indentations 223*c* on the top portion 223 may receive each of the plurality of inward protruding ribs 233 on the removable lid 230.

Additionally, the removable lid 230 may be constructed, such that the inward declining top surface 231 does not contact the inner wall 221. In other words, a length of the inward declining top surface 231 extending from the outer edge 231*a* to the inner edge 231*b* may be less than a distance of the paint storing portion 220 extending from the outer wall 222 to the inner wall 221. In other words, a gap 240 may be formed between the inner edge 231*b* of the inward declining top surface 231 and the inner wall 221 of the paint storing portion 220.

Furthermore, the paint may seep inside the paint storing portion 220 in response to the paint contacting the inward declining top surface 231. Specifically, any paint contacting at least a portion of the inward declining top surface 231 may travel toward the inner edge 231*b* and into the paint storing portion 220 via the gap 240, due to the inner edge 231 being at a lower elevation than the outer edge 231*a*. In other words, the inward declining top surface may direct the paint spilled (i.e., leaked out) thereon, toward the paint storing portion 220.

Alternatively, spilled paint that runs down a side of the paint can 10 may enter the paint storing portion 220 via the gap 240, for at least the reason that the paint can 10 fits snugly within the can receiving portion 210.

The paint can 10 may be inserted into the can receiving portion 210, such that the wall 211 of the can receiving portion 210 may contact an outer surface of the paint can 10, such that the paint storing portion 220 may receive the paint spilled out from the paint can 10.

Referring to FIG. 6B, the base 213 of the can receiving portion 210 may be substantially coplanar with respect to the base 224*a* of the bottom portion 224. The plurality of horizontal ribs 224*b* may be recessed portions of the base 224*a* for each of the plurality of horizontal ribs 224*b*. Additionally, the top portion 223 may have a circumference greater than a circumference of the bottom portion 224.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A paint can caddie, comprising:

a can receiving portion to receive a base and at least a portion of an outer circumference of a paint can therein;

a paint storing portion circumferentially disposed around the can receiving portion to receive paint spilled from the paint can; and a removable lid attached only to a top portion of a circular edge of the paint storing portion, the removable lid comprising:

an inward declining top surface sloping downward from an outer edge of the inward declining top surface toward an inner edge of the inward declining top surface to direct spilled paint thereon into the paint storing portion, such that removing the removable lid from the top portion of the circular edge of the paint storing portion removes the inward declining top surface from being disposed over the paint storing portion.

2. The paint can caddie of claim 1, further comprising:

a gap formed between the inner edge of the inward declining top surface and the inner wall of the paint storing portion to allow the paint to enter the paint storing portion.

3. The paint can caddie of claim 1, wherein the removable lid comprises:

a plurality of inward protruding ribs disposed on at least a portion of an outer surface of the removable lid.

4. The paint can caddie of claim 3, wherein the paint storing portion comprises:

a plurality of rib receiving indentations disposed on at least a portion of an outer surface of the paint storing portion to each receive one of the plurality of inward protruding ribs.

5. The paint can caddie of claim 1, wherein the can receiving portion further comprises:

a plurality of vertical ribs to accommodate a predetermined range of size of the paint can, such that the plurality of vertical ribs deform to allow the paint can to fit snugly within the can receiving portion.

6. The paint can caddie of claim 1, wherein the paint storing portion comprises:

an inner wall disposed next to a wall of the can receiving portion;

an outer wall disposed around and distanced from the inner wall; and a base disposed at a bottom portion of the paint storing portion to connect the inner wall to the outer wall.

7. A paint can caddie, comprising:

a can receiving portion to receive a base and at least a portion of an outer circumference of a paint can therein, the can receiving portion comprising:

a plurality of vertical ribs to accommodate a predetermined range of size of the paint can, such that the plurality of vertical ribs deform to allow the paint can to fit snugly within the can receiving portion;

a paint storing portion circumferentially disposed around the can receiving portion to receive paint spilled from the paint can; and a removable lid attached only to a top portion of a circular edge of the paint storing portion, the removable lid comprising:

an inward declining top surface sloping downward from an outer edge of the inward declining top surface toward an inner edge of the inward declining top surface to direct spilled paint thereon into the paint storing portion, such that removing the removable lid from the top portion of the circular edge of the paint storing portion removes the inward declining top surface from being disposed over the paint storing portion.

8. A paint can caddie, comprising:

a can receiving portion to receive a base and at least a portion of an outer circumference of a paint can therein;

a paint storing portion circumferentially disposed around the can receiving portion to receive paint spilled from the paint can, the paint storing portion comprising:

an inner wall disposed next to a wall of the can receiving portion, an outer wall disposed around and distanced from the inner wall, and a base disposed at a bottom portion of the paint storing portion to connect the inner wall to the outer wall; and a removable lid attached only to a top portion of a circular edge of the paint storing portion, the removable lid comprising:

an inward declining top surface sloping downward from an outer edge of the inward declining top surface toward an inner edge of the inward declining top surface to direct spilled paint thereon into the paint storing portion, such that removing the removable lid from the top portion of the circular edge of the paint storing portion removes the inward declining top surface from being disposed over the paint storing portion.

* * * * *